United States Patent [19]

Feller

[11] Patent Number: 4,516,377

[45] Date of Patent: May 14, 1985

[54] ROLLABLE GRATING SYSTEM

[76] Inventor: Samuel Feller, Roide, Pont de Roide, France, 25150

[21] Appl. No.: 459,041

[22] Filed: Jan. 17, 1983

[30] Foreign Application Priority Data

Jan. 18, 1982 [FR] France ..... 82 00669

[51] Int. Cl.[3] ..... E04C 2/42

[52] U.S. Cl. ..... 52/660

[58] Field of Search ..... 52/660, 661, 662, 663, 52/665, 664, 669, 670, 671, 674, 180, 177

[56] References Cited

U.S. PATENT DOCUMENTS 1,924,570 8/1933 Rothman ..... 52/180

2,390,194 12/1945 Tarof ..... 52/660

FOREIGN PATENT DOCUMENTS 23474 12/1892 United Kingdom ..... 52/660

352249 7/1931 United Kingdom ..... 52/660

*Primary Examiner*—John E. Murtagh

*Assistant Examiner*—Kathryn L. Ford

*Attorney, Agent, or Firm*—Wenderoth, Lind & Ponack

[57] ABSTRACT

A rollable grating includes tubes of anodized aluminum alloy, assembled through the agency of fasteners, each of which includes two portions, surrounding each bend of one of the tubes to be assembled. The two fastener portions are connected to each other via a connection bar.

4 Claims, 4 Drawing Figures

ROLLABLE GRATING SYSTEM

FIELD OF THE INVENTION

For providing the closing of premises, and notably of shops and similar establishments, rollable gratings are used. The rollable gratings most commonly used are made of undulating or wavy galvanized steel tubes. The assembly or connection of the tubes to each other is generally provided by using ties of galvanized steel strips, comprising fastening lugs.

BACKGROUND OF THE INVENTION

In order to illustrate the prior art technique, reference can be made to FIGS. 1 and 2 of the accompanying drawings. In FIG. 1 is shown, in frontal elevation, a detail of a known rollable grating, and in FIG. 2, at a larger scale and in a vertical cross-section, one of the ties used for the connection of the bends or elbows of the wavy tubes 10 and the horizontal tubes 12 forming the grating. In FIG. 2, one sees that the tie 14 which closes the assembly formed by two wavy tubes and a horizontal tube is provided in the form of a metal-strip with a fastening lug 16.

Usually, such gratings and their mode of connection is generally satisfactory. However, they have the disadvantages of being relatively heavy and having to be periodically painted. It is quite obvious that such painting operations, repeated several times, do not favour the operation of the system. On the other hand, even a painting made on galvanized parts provides only an imperfect protection against corrosion. Finally, the weight of the steel grating requires relatively heavy control members.

OBJECTS AND SUMMARY OF THE INVENTION

To remedy the disadvantages of the known rollable gratings, the present invention provides a grating which is light weight as well as resistant, while presenting all necessary guarantees as regards the solution to the problems occuring due to corrosion. To this effect, one used according to the invention an aluminum alloy adapted to anodization, for forming the elements of the grating.

The main difficulty encountered in making and putting the finishing touch to such a rollable grating involved the connection of the wavy tubes to each other. Indeed, a fixation means had to be designated so that the geometry of such means was not modified when mounting the grating, in order to provide a perfect mechanical operation, and the anodization of which was not deteriorated by using tools such as pliers or hammers.

According to the present invention, this problem has been solved by using a connection means for the anodized aluminum alloy wavy tubes, formed by a fastener in two portions, each portion surrounding the elbow or bend of one of the tubes to be assembled. The portions are connected to each other by a connection bar formed of an anodized and drawn aluminum section or member.

According to the invention, the connection bar has a length identical to that of the wavy tube, and it is formed with two side horizontal slots opening toward inner bores which respectively receive fastening lugs of each of the portions of the fastener.

BRIEF DESCRIPTION OF THE DRAWINGS

Further features and advantages of this invention will become more apparent in the following description, with reference to the accompanying drawings, illustrating a nonlimiting embodiment of the invention.

In the drawings.

DETAILED DESCRIPTION OF THE INVENTION

Figure 1:
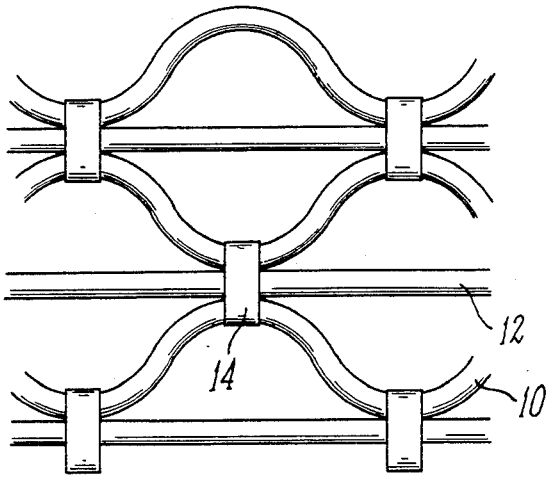
FIG. 1 PRIOR ART
FIG. 1 is a partial frontal elevation view of a grating according to the prior art and hereabove described.
Figure 2:
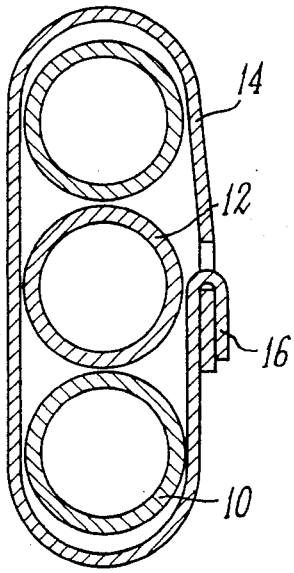
FIG. 2 PRIOR ART
FIG. 2 is a vertical sectional view at a larger scale of the known fastener, also hereabove described.
Figure 3:
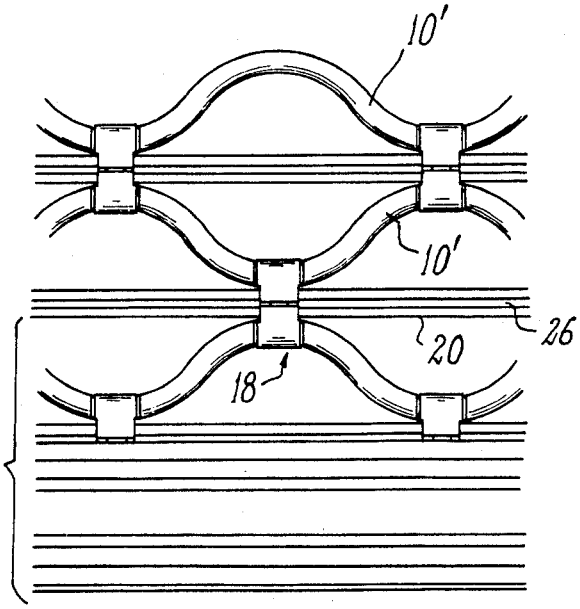
FIG. 3 is a view similar to FIG. 1, showing a rollable grating according to the invention.
Figure 4:
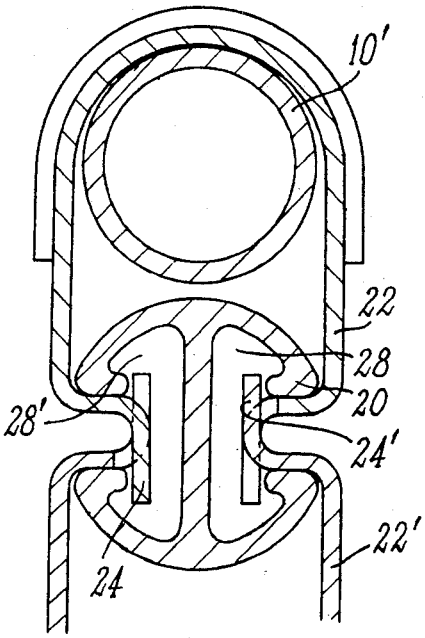
FIG. 4 is a vertical sectional partial view at a larger scale of a fastener used by the invention for connecting the wavy tubes constituent of the grating.

Reference is now made to FIGS. 3 and 4.

The grating according to the invention is made of the assembly of wavy tubes 10' made of an anodized aluminum allow, the assembly being provided with the assistance of connecting fasteners, designated as a whole by reference 18, and of horizontal connection bars 20.

Each fastener is made of two portions 22—22' (FIG. 4), each portion surrounding the bent portion of one of the wavy tubes 10' to be connected. The two portions of the fastener are connected to each other by the connecting bar 20, which is made of a drawn anodized aluminum member. The shape of the member is chosen such that it includes two side horizontal slots, such as 26, opening into inner bores or cavities 28 and 28' adapted for receiving respectively fastening lugs 24—24' of the portions 22—22' of the fastener.

The mounting is performed in the following manner:

The fastener portions such as 22 and 22' are threaded onto the whole length of tubes 10', at the rate of one portion, or half-fastener, per wave.

The half-fasteners 22, 22' are then brought near each other, and the connection bar 20 is caused to slide between them, as shown in FIGS. 3 and 4. Connecting bar 20, which has the same length as the wavy tubes, thus provides the connection of the tubes to each other by rigidly connecting the two respective portions of each fastener 18.

The grating according to the present invention is aesthetic, robust, light in weight (about 5 kg/m$^2$), durable due to its anti-corrosion protection, and requires no maintenance.

Obviously, the present invention is not limited to the embodiment described and shown, and it encompasses all its alternatives.

What I claim is:

1. In a rollable grating system of the type including a plurality of wavy tubes, and means for joining adjacent said tubes at adjacent waves thereof, the improvement wherein:

said tubes are formed of an anodized aluminum alloy;

said joining means comprise a connecting bar extending longitudinally between adjacent said tubes, and fasteners connecting respective pairs of adjacent said waves to the respective said bar;

said bar having therethrough longitudinal cavities, and longitudinal slots opening through opposite sides of said bar into respective said cavities; and each said fastener comprises two portions, each said portion fitting around a respective said wave of a said pair of adjacent waves, and said portions of each said fastener having lugs extending through said slots and into said cavities of the respective said bar.

2. The improvement claimed in claim 1, wherein each said portion has two lugs, each of which extends into a respective said cavity.

3. The improvement claimed in claim 1, wherein each said bar comprises a drawn member formed of anodized aluminum.

4. The improvement claimed in claim 3, wherein each said member has a length equal to that of the adjacent said tubes.

* * * * *